US006022122A

United States Patent [19]

Limardo

[11] Patent Number: 6,022,122

[45] Date of Patent: Feb. 8, 2000

[54] DECORATIVE LAMP

[76] Inventor: Castro L. Limardo, P.O. Box 612110, North Miami, Fla. 33161

[21] Appl. No.: 09/141,194

[22] Filed: Aug. 27, 1998

[51] Int. Cl.[7] ..... F21V 21/30

[52] U.S. Cl. ..... 362/191; 362/311; 362/397; 362/806

[58] Field of Search ..... 362/806, 396, 362/397, 310, 311, 190, 191; 40/597, 564

[56] References Cited

U.S. PATENT DOCUMENTS

| | | | |
|---|---|---|---|
| 1,856,519 | 5/1932 | Spears | 362/397 |
| 2,675,983 | 4/1954 | King | 362/397 |
| 4,351,506 | 9/1982 | Ohai | 362/396 |
| 4,989,120 | 1/1991 | Davis et al. | 362/806 |
| 5,359,506 | 10/1994 | Koleno | 362/806 |
| 5,396,408 | 3/1995 | Szczech, III | 362/806 |
| 5,513,084 | 4/1996 | Simpson | 362/311 |
| 5,545,069 | 8/1996 | Glynn et al. | 362/253 |
| 5,692,826 | 12/1997 | Hsien-Jung | 362/191 |

*Primary Examiner*—Thomas M. Sember

[57] ABSTRACT

A decorative lamp for displaying a back lit image thereon including a case having a hole therethrough with spaced apart and generally transparent front and back panes provided in the hole. A decorative design is provided on the front pane. A light source is extended from the case into the hole between the front and back panes. A power source is provided in the case and electrically connected to the light source. A suspension tab is coupled to the case. An elongate flexible member is coupled to the suspension tab for suspending the case from a structure.

10 Claims, 2 Drawing Sheets

DECORATIVE LAMP

BACKGROUND OF THE INVENTION

1. Field of the Invention

The present invention relates to lamps and more particularly pertains to a new decorative lamp for displaying a back lit image thereon.

2. Description of the Prior Art

The use of lamps is known in the prior art. More specifically, lamps heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,226,866; U.S. Pat. No. 3,205,600; U.S. Pat. No. 2,902,787; U.S. Pat. No. 2,806,939; U.S. Pat. No. 2,052,877; and U.S. Pat. No. Des. 379,376.

While these devices fulfill their respective, particular objectives and requirements, the aforementioned patents do not disclose a new decorative lamp. The inventive device includes a case having a hole therethrough with spaced apart and generally transparent front and back panes provided in the hole. A decorative design is provided on the front pane. A light source is extended from the case into the hole between the front and back panes. A power source is provided in the case and electrically connected to the light source. A suspension tab is coupled to the case. An elongate flexible member is coupled to the suspension tab for suspending the case from a structure.

In these respects, the decorative lamp according to the present invention substantially departs from the conventional concepts and designs of the prior art, and in so doing provides an apparatus primarily developed for the purpose of displaying a back lit image thereon.

SUMMARY OF THE INVENTION

In view of the foregoing disadvantages inherent in the known types of lamps now present in the prior art, the present invention provides a new decorative lamp construction wherein the same can be utilized for displaying a back lit image thereon.

The general purpose of the present invention, which will be described subsequently in greater detail, is to provide a new decorative lamp apparatus and method which has many of the advantages of the lamps mentioned heretofore and many novel features that result in a new decorative lamp which is not anticipated, rendered obvious, suggested, or even implied by any of the prior art lamps, either alone or in any combination thereof.

To attain this, the present invention generally comprises a case having a hole therethrough with spaced apart and generally transparent front and back panes provided in the hole. A decorative design is provided on the front pane. A light source is extended from the case into the hole between the front and back panes. A power source is provided in the case and electrically connected to the light source. A suspension tab is coupled to the case. An elongate flexible member is coupled to the suspension tab for suspending the case from a structure.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new decorative lamp apparatus and method which has many of the advantages of the lamps mentioned heretofore and many novel features that result in a new decorative lamp which is not anticipated, rendered obvious, suggested, or even implied by any of the prior art lamps, either alone or in any combination thereof.

It is another object of the present invention to provide a new decorative lamp which may be easily and efficiently manufactured and marketed.

It is a further object of the present invention to provide a new decorative lamp which is of a durable and reliable construction.

An even further object of the present invention is to provide a new decorative lamp which is susceptible of a low cost of manufacture with regard to both materials and labor, and which accordingly is then susceptible of low prices of sale to the consuming public, thereby making such decorative lamp economically available to the buying public.

Still yet another object of the present invention is to provide a new decorative lamp which provides in the apparatuses and methods of the prior art some of the advantages thereof, while simultaneously overcoming some of the disadvantages normally associated therewith.

Still another object of the present invention is to provide a new decorative lamp for displaying a back lit image thereon.

Yet another object of the present invention is to provide a new decorative lamp which includes a case having a hole therethrough with spaced apart and generally transparent front and back panes provided in the hole. A decorative design is provided on the front pane. A light source is extended from the case into the hole between the front and back panes. A power source is provided in the case and electrically connected to the light source. A suspension tab is coupled to the case. An elongate flexible member is coupled to the suspension tab for suspending the case from a structure.

Still yet another object of the present invention is to provide a new decorative lamp that may display an illuminated image of a flag thereon.

Even still another object of the present invention is to provide a new decorative lamp that provides an exciting and less dreary means to display an image.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
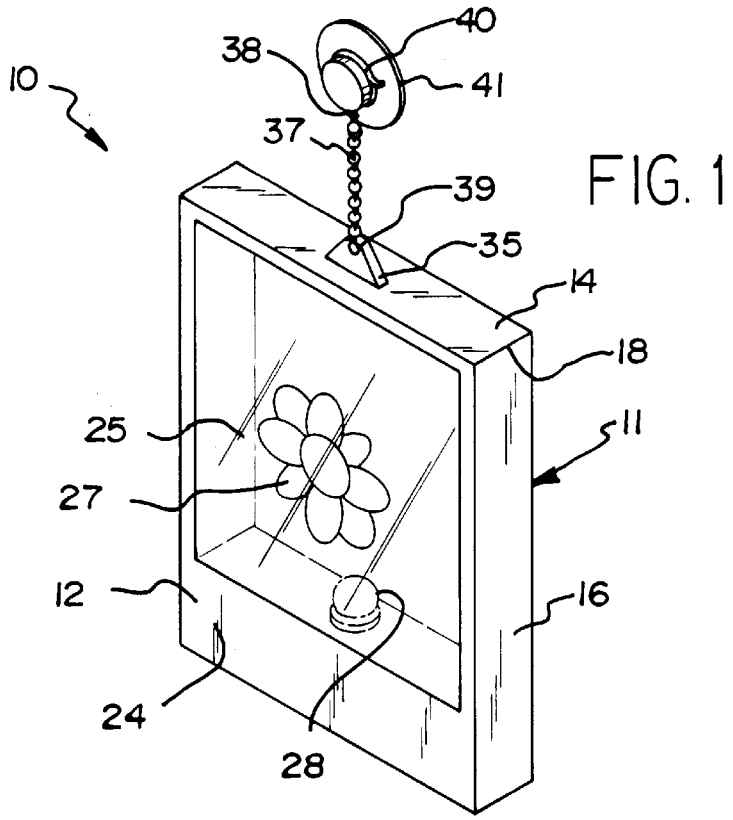
FIG. 1 is a schematic front perspective view of a new decorative lamp according to the present invention.
Figure 2:
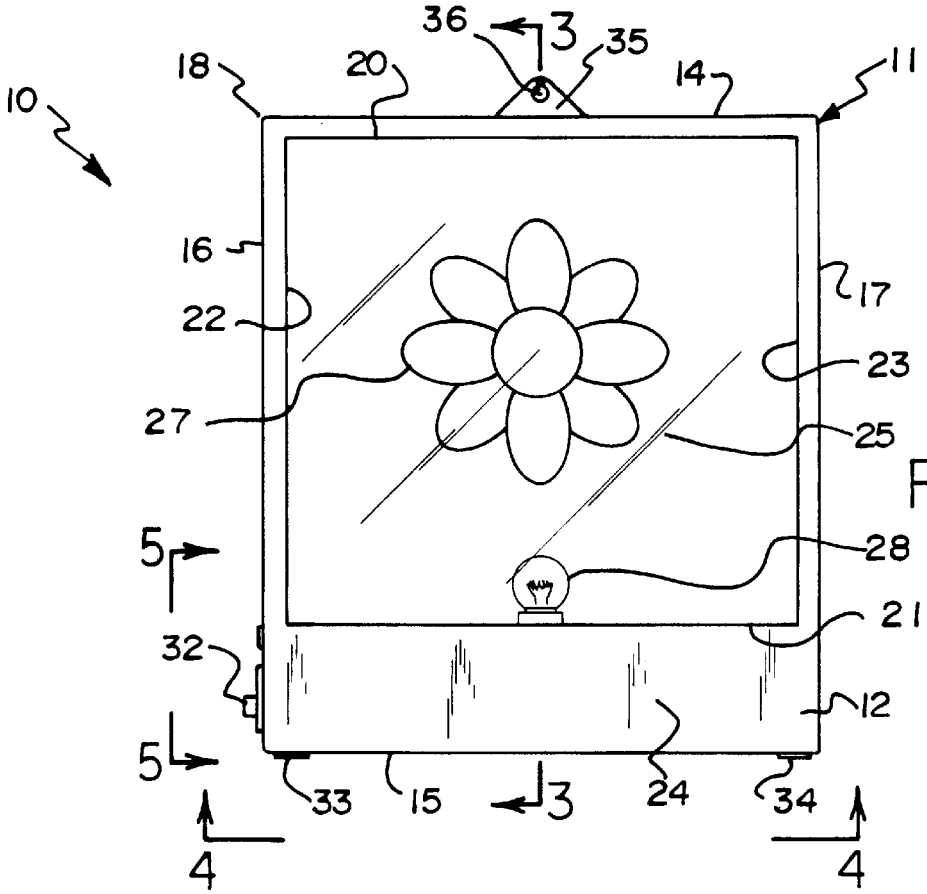
FIG. 2 is a schematic front side view of the present invention.
Figure 3:
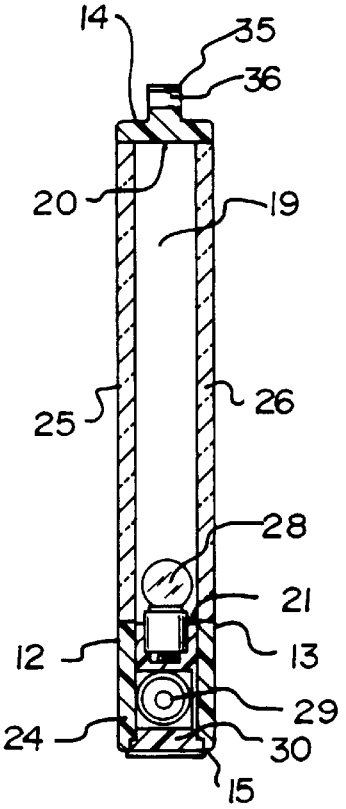
FIG. 3 is a schematic cross sectional view of the present invention taken from line 3—3 on FIG. 2.
Figure 4:
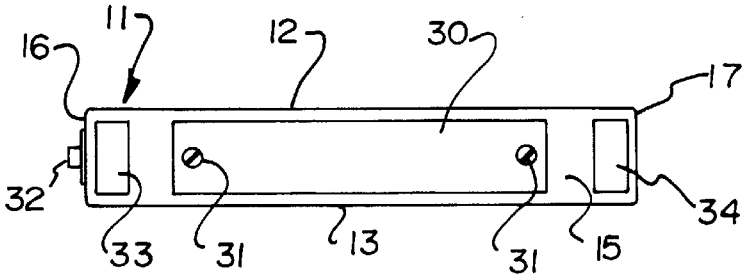
FIG. 4 is a schematic bottom side view of the present invention taken from the vantage of line 4—4 of FIG. 2.
Figure 5:
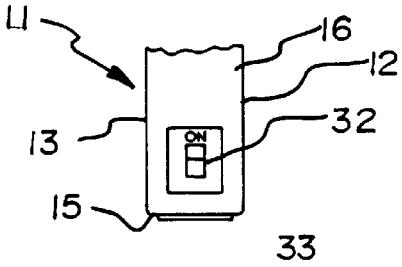
FIG. 5 is a schematic partial side view of the present invention.
Figure 6:
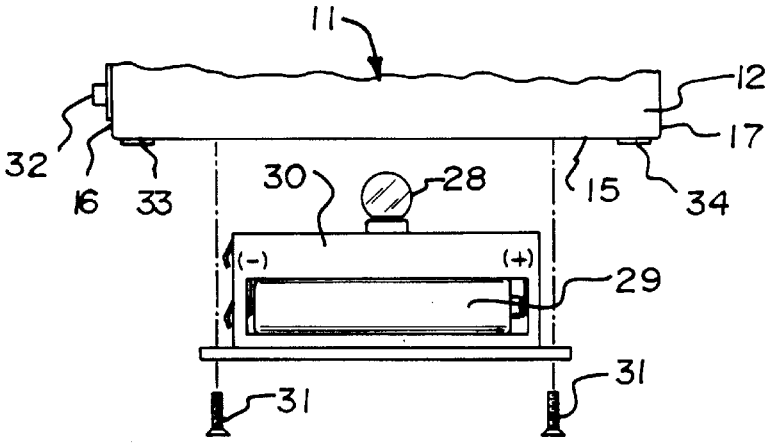
FIG. 6 is a schematic partial exploded side view of the present invention.

With reference now to the drawings, and in particular to FIGS. 1 through 6 thereof, a new decorative lamp embodying the principles and concepts of the present invention and generally designated by the reference numeral 10 will be described.

As best illustrated in FIGS. 1 through 6, the decorative lamp 10 generally comprises a case 11 having a hole 19 therethrough with spaced apart and generally transparent front and back panes 25,26 provided in the hole 19. A decorative design 27 is provided on the front pane 25. A light source 28 is extended from the case 11 into the hole 19 between the front and back panes 25,26. A power source 29 is provided in the case 11 and electrically connected to the light source 28. A suspension tab 35 is coupled to the case 11. An elongate flexible member 37 is coupled to the suspension tab 35 for suspending the case 11 from a structure.

In closer detail, the case 11 is generally rectangular in configuration and has generally flat front and back faces 12,13, generally straight top and bottom ends 14,15, a pair of generally straight lateral sides 16,17 extending between the top and bottom ends 14,15 of the case 11, and a plurality of corner edges 1 with each corner edge 18 located adjacent an intersection of an end and side of the case 11. Ideally, the corner edges 18 of the case 11 are rounded to prevent the corner edges 18 for damaging surrounding structures.

The front and back faces 12,13 of the case 11 lying in generally parallel planes to one another, the top and bottom ends 14,15 of the case 11 lying in generally parallel planes to one another, the lateral sides 16,17 of the case 11 lying in generally parallel planes to one another and generally perpendicular to the planes of the top and bottom ends 14,15 of the case 11. The planes of the front and back faces 12,13 of the case 11 are generally perpendicular to the planes of the top and bottom ends 14,15 and the lateral sides 16,17 of the case 11.

Preferably, the case 11 comprises a generally opaque material to prevent passage of light therethrough. Ideally, the case 11 comprises a generally rigid opaque plastic material for providing strength and is relatively light weight. The case 11 has a thickness defined between the front and back faces 12,13 of the case 1 1, a length defined between the top and bottom ends 14,15 of the base, and a width defined between the lateral sides 16,17 of the case 11.

The case 11 has a hole 19 therethrough between the front and back faces 12,13 of the case 11. The hole 19 has a generally rectangular outer periphery. The outer periphery of the hole 19 has generally parallel top and bottom end portions 20,21 and a pair of generally parallel side portions 22,23. Preferably, the hole 19 of the case 11 is positioned towards the top end 14 of the case 11 such that the hole 19 is generally equally spaced apart from the top end 14 and the lateral sides 16,17 of the case 11. The top end portion 20 of the hole 19 is positioned towards the top end 14 of the case 11. The bottom end portion 21 of the hole 19 is positioned towards the bottom end 15 of the case 11. Each of the side portions 22,23 of the hole 19 is positioned adjacent an associated lateral side 16,17 of the case 11. The top and bottom end portions 20,21 of the hole 19 preferably extend generally parallel to the top and bottom ends 14,15 of the case 11 and the side portions 22,23 of the hole 19 extend generally parallel to the lateral sides 16,17 of the case 11. The hole 19 of the case 11 has a length defined between the top and bottom end portions 20,21 of the case 11 and a width defined between the side portions 22,23 of the hole 19.

Spaced apart and generally transparent front and back panes 25,26 are provided in the hole 19 of the case 11. The front and back panes 25,26 each are extended substantially across the outer perimeter of the hole 19 of the case 11 to substantially cover the hole 19. The front and back panes 25,26 are generally flat and have a generally rectangular configuration. The front pane 25 and the front face 12 of the case 11 preferably generally lie in a common plane while the back pane 26 and the back face 13 of the case 11 preferably generally lie in a common plane. A decorative design 27 or image (such as a flag or a flower, as illustrated) is provided on the front pane 25. Ideally, the design is generally translucent such that an amount of light may pass therethrough.

The case 11 has a base region 24 defined between the bottom end portion 21 of the hole 19 and the bottom end 15 of the case 11. A light source 28 (such as a light bulb) is extended from the base region 24 into the hole 19 between the front and back panes 25,26. The light source 28 is designed for illumination and for back lighting the decorative image. The light source 28 is preferably centrally positioned between the side portions 22,23 of the hole 19 of the case 11. A power source 29 is provided in the base region 24 of the case 11 and electrically connected to the light source 28 for providing energy to the light source 28,.

Preferably, the power source 29 comprises a battery. A switch 32 is mounted to one of the lateral sides 16 of the case 11 towards the bottom end 15 of the case 11. The switch 32 is electrically connected to the light source 28 to permit selective activation of the light source 28.

In a preferred embodiment, the light source 28 and the power source 29 are mounted to a separable portion 30 of the base region 24 of the case 11. The separable portion 30 of the base region 24 is detachably attached to the case 11 by a pair of threaded fasteners 31 to permit user access to the light source 28 and the power source 29 for easy light source 28 and power source 29 replacement.

A pair of spaced apart resting pads 33,34 are coupled to the bottom end 15 of the case 11. The resting pads 33,34 are designed for resting on a surface when the bottom end of the case is rested on the surface. One of the resting pads 33 is positioned adjacent one of the lateral sides 16 of the case 11 and the other resting pad 34 is positioned adjacent the other lateral side 17 of the case 11. Each of the resting pads 33,34 has a generally rectangular configuration and each of the resting pads 33, 34 ideally comprises a resiliently compressible material such as a resiliently compressible rubber.

A suspension tab 35 is coupled to the top end 14 of the case 11. The suspension tab 35 has a generally triangular configuration and is preferably centrally positioned on the top end 14 of the case 11 between the lateral sides 16,17 of the case 11. The suspension tab 35 preferably lies in a plane generally parallel to the planes of the front and back faces 12,13 of the case 11 and located generally equidistant between the planes of front and back faces 12,13 of the case 11. The suspension tab 35 has a free vertex outwardly extending from the top end 14 of the case 11. The suspension tab 35 also has an aperture 36 therethrough preferably located adjacent the free vertex of the suspension tab 35.

An elongate flexible member 37 is provided having opposite upper and lower ends 38,39. Ideally, the flexible member 37 comprises a length of chain. The lower end 39 of the flexible member 37 is coupled to the suspension tab 35. Preferably, the lower end 39 of the flexible member 37 is looped through the aperture 36 of the suspension tab 35 to couple the lower end 39 of the flexible member 37 to the suspension tab 35. The upper end 38 of the flexible member 37 is designed for attaching to a structure to permit suspension of the case 11 from the structure. Preferably, the upper end 38 of the flexible member 37 has a hook 40 designed for hooking on to a structure such as a rear view mirror to attach the upper end 38 of the flexible member 37 to the structure. A suction cup 41 designed for suctional attachment to a structure such as a window may also preferably provided. The hook 40 of the upper end 38 of the flexible member 37 may be hooked onto the suction cup 41 to suspend the case 11 from the suction cup.

In an ideal illustrative embodiment, the thickness of the case 11 is about ⅜ inch, the length of the case 11 is about 5½ inches, and the width of the case 11 is about 3¾ inches. These dimensions are optimal for hanging in a vehicle such as a car and on a window without substantially blocking the view through the window. In this ideal embodiment, it is preferred that the length of each of the panes is about 4⅛ inches and the width is about 3⅜ inches. Also, the flexible member 37 ideally has a length defined between the upper and lower ends 38,39 of the flexible member 37 of about 1⅞ inches so that the case 11 can be suspended from a rear view mirror of a vehicle without substantially obstructing the view of the user of the vehicle and so that the panes are about eye level with the driver of the vehicle.

In use, the light source is activated to provide light through the panes and to back light the decorative design. The bottom end of the case may be rested on a surface so that the case is generally vertical or the flexible member may be attached to a structure to suspend the case below the structure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A decorative lamp for hanging on a vertical wall surface for positioning adjacent to the vertical wall surface, the lamp comprising:

a case having front and back faces, top and bottom ends, a pair of lateral sides extending between said top and bottom ends of said case;

said case having a hole therethrough between said front and back faces of said case;

said front and back faces are substantially planar for stabilly positioning adjacent the vertical wall surface;

said case having a base region defined between said hole and said bottom end of said case;

spaced apart and generally transparent front and back panes being provided in said hole of said case;

a decorative design being provided on said front pane, wherein said design is generally translucent;

a light source being extended from said base region into said hole between said front and back panes;

a power source being provided in said base region of said case and electrically connected to said light source;

a suspension tab being coupled to said top end of said case;

an elongate flexible member having opposite upper and lower ends, said lower end of said flexible member being coupled to said suspension tab, said upper end of said flexible member being adapted for attaching to a structure to permit suspension of said case from the structure; and wherein said front and back faces of said case lie in generally parallel planes to one another and said lateral sides of said case lie in generally parallel planes to one another and generally perpendicular to said planes of said front and back faces of said case.

2. The decorative lamp of claim 1, wherein said case comprises a generally opaque material to prevent passage of light therethrough.

3. The decorative lamp of claim 1, wherein said case has a plurality of rounded corner edges for preventing said corner edges for damaging surrounding structures.

4. The decorative lamp of claim 1, wherein said hole has a generally rectangular outer periphery, said outer periphery of said hole having generally parallel top and bottom end portions and a pair of generally parallel side portions.

5. The decorative lamp of claim 4, wherein said hole of said case is positioned towards said top end of said case such that said hole is generally equally spaced apart from said top end and said lateral sides of said case, said top end portion of said hole being positioned towards said top end of said case, said bottom end portion of said hole being positioned towards said bottom end of said case, each of said side portions of said hole being positioned adjacent an associated lateral side of said case.

6. The decorative lamp of claim 1, wherein said front and back panes are generally flat and have a generally rectangular configuration, said front pane and said front face of said case generally lying in a common plane, said back pane and said back face of said case generally lying in a common plane.

7. The decorative lamp of claim 1, wherein said light source and said power source are mounted to a separable portion of said base region of said case, said separable portion of said base region being detachably attached to said case to permit user access to said light source and said power source.

8. The decorative lamp of claim 1, further comprising a switch being mounted to one of said lateral sides of said case towards said bottom end of said case, said switch being electrically connected to said light source.

9. The decorative lamp of claim 1, wherein said flexible member comprises a length of chain.

10. A decorative lamp, comprising:

a case being generally rectangular in configuration and having generally flat front and back faces, generally straight top and bottom ends, a pair of generally straight lateral sides extending between said top and bottom ends of said case, and a plurality of corner edges;

wherein said case comprises a generally opaque material to prevent passage of light therethrough;

said front and back faces of said case lying in generally parallel planes to one another, said top and bottom ends of said case lying in generally parallel planes to one another, said lateral sides of said case lying in generally parallel planes to one another and generally perpendicular to said planes of said top and bottom ends of said case, said planes of said front and back faces of said case being generally perpendicular to said planes of said top and bottom ends and said lateral sides of said case;

wherein said corner edges of said case are rounded to prevent said corner edges for damaging surrounding structures;

said case having a thickness defined between said front and back faces of said case, a length defined between said top and bottom ends of said base, and a width defined between said lateral sides of said case;

said case having a hole therethrough between said front and back faces of said case, said hole having a generally rectangular outer periphery, said outer periphery of said hole having generally parallel top and bottom end portions and a pair of generally parallel side portions;

said hole of said case being positioned towards said top end of said case such that said hole is generally equally spaced apart from said top end and said lateral sides of said case, said top end portion of said hole being positioned towards said top end of said case, said bottom end portion of said hole being positioned towards said bottom end of said case, each of said side portions of said hole being positioned adjacent an associated lateral side of said case;

said top and bottom end portions of said hole extending generally parallel to said top and bottom ends of said case, said side portions of said hole extending generally parallel to said lateral sides of said case;

said hole of said case having a length defined between said top and bottom end portions of said case and a width defined between said side portions of said hole;

said case having a base region defined between said bottom end portion of said hole and said bottom end of said case;

spaced apart and generally transparent front and back panes being provided in said hole of said case, said front and back panes each being extended substantially across said outer perimeter of said hole of said case, said front and back panes being generally flat and having a generally rectangular configuration, said front pane and said front face of said case generally lying in a common plane, said back pane and said back face of said case generally lying in a common plane;

a decorative design being provided on said front pane, wherein said design is generally translucent;

a light source being extended from said base region into said hole between said front and back panes, said light source being centrally positioned between said side portions of said hole of said case;

a power source being provided in said base region of said case and electrically connected to said light source, wherein said power source comprises a battery;

said light source and said power source being mounted to a separable portion of said base region of said case, said separable portion of said base region being detachably attached to said case to permit user access to said light source and said power source;

a switch being mounted to one of said lateral sides of said case towards said bottom end of said case, said switch being electrically connected to said light source;

a pair of spaced apart resting pads being coupled to said bottom end of said case, one of said resting pads being positioned adjacent one of said lateral sides of said case, another of said resting pads being positioned adjacent another of said lateral sides of said case;

each of said resting pads having a generally rectangular configuration and each of said resting pads comprising a resiliently compressible material;

a suspension tab being coupled to said top end of said case, said suspension tab having a generally triangular configuration and being centrally positioned on said top end of said case between said lateral sides of said case;

said suspension tab lying in a plane generally parallel to said planes of said front and back faces of said case and located generally equidistant between said planes of front and back faces of said case;

said suspension tab having a free vertex outwardly extending from said top end of said case;

said suspension tab having an aperture therethrough, said aperture being located adjacent said free vertex of said suspension tab;

an elongate flexible member having opposite upper and lower ends, wherein said flexible member comprises a length of chain, said lower end of said flexible member being coupled to said suspension tab, wherein said lower end of said flexible member being looped through said aperture of said suspension tab to couple said lower end of said flexible member to said suspension tab;

said upper end of said flexible member being adapted for attaching to a structure to permit suspension of said case from the structure, said upper end of said flexible member having a hook adapted for hooking on to a structure to attach the upper end of the flexible member to the structure; and a suction cup adapted for suctional attachment to a structure, said hook of said upper end of said flexible member being hooked onto said suction cup.

* * * * *